US005173383A

United States Patent [19]

Kashizaki et al.

[11] Patent Number: 5,173,383

[45] Date of Patent: Dec. 22, 1992

[54] ELECTROPHOTOGRAPHIC PHOTOSENSITIVE MEMBER, AND ELECTROPHOTOGRAPHIC APPARATUS AND FACSIMILE MACHINE EMPLOYING THE SAME

[75] Inventors: Yoshio Kashizaki; Hajime Miyazaki, both of Yokohama; Toshie Miyaji, Kawasaki, all of Japan

[73] Assignee: Canon Kabushiki Kaisha, Tokyo, Japan

[21] Appl. No.: 812,108

[22] Filed: Dec. 23, 1991

[30] Foreign Application Priority Data

Dec. 26, 1990 [JP] Japan ..... 2-406670

[51] Int. Cl.[5] ..... G03G 5/06

[52] U.S. Cl. ..... 430/58; 430/66; 430/73; 355/296; 358/401

[58] Field of Search ..... 430/58, 66, 73; 355/296; 358/401

[56] References Cited

U.S. PATENT DOCUMENTS

| | | | |
|---|---|---|---|
| 4,507,471 | 3/1985 | Ohta | 430/73 |
| 4,760,003 | 7/1988 | Matsumoto et al. | 430/58 |
| 4,868,080 | 9/1989 | Umehara et al. | 430/73 |
| 5,077,164 | 12/1991 | Ueda et al. | 430/73 |

FOREIGN PATENT DOCUMENTS

| | | |
|---|---|---|
| 1007095 | 3/1977 | Canada . |
| 78575 | 5/1983 | European Pat. Off. . |
| 2155547 | 5/1973 | France . |
| 2697942 | 6/1988 | France . |
| 57-116345 | 7/1982 | Japan . |
| 58-95742 | 6/1983 | Japan . |

*Primary Examiner*—John Goodrow

*Attorney, Agent, or Firm*—Fitzpatrick, Cella, Harper & Scinto

[57] ABSTRACT

An electrophotographic photosensitive member comprises an electroconductor support and a photosensitive layer formed thereon. The photosensitive layer contains at least one of the azo pigments represented by the formula [1], [2], or [3] below:

[1]

[2]

[3]

14 Claims, 1 Drawing Sheet

ELECTROPHOTOGRAPHIC PHOTOSENSITIVE MEMBER, AND ELECTROPHOTOGRAPHIC APPARATUS AND FACSIMILE MACHINE EMPLOYING THE SAME

BACKGROUND OF THE INVENTION

1. Field of the Invention

The present invention relates to an electrophotographic photosensitive member, more particularly to an electrophotographic photosensitive member which comprises a photosensitive layer containing an azo pigment of a specified chemical structure.

The present invention also relates to an electrophotographic apparatus and a facsimile machine employing the photosensitive member 2. Related Background Art Electrophotographic photosensitive members composed of an organic photoconductive substance include photoconductive polymers typified by poly-N-vinylcarbazole, low-molecular organic photoconductive substances like 2,5-bis(p-diethylaminophenyl)-1,3,4-oxadiazole, and combinations of such an organic photoconductive substance with a dye or a pigment.

Electrophotographic photosensitive members employing an organic photoconductive substance have advantages that the photoconductive members are producible by a coating method with high productivity at a relatively low cost, and that the electrophotographic characteristics thereof is arbitrarily controlled by selecting the dye or the pigment to be used. Therefore, the electrophotographic photosensitive members have comprehensively been investigated. Recently, function-separation type photosensitive members have been developed which have a lamination structure comprising a charge-generating layer containing an organic photoconductive dye, a pigment, or the like and a charge-transporting layer containing aforementioned photoconductive polymer or a low-molecular organic electroconductive substance. The development of the function-separation type ones has improved remarkably the sensitivity and the durability of conventional organic electrophotographic photosensitive members.

Among organic photoconductive substances, many azo pigments have superior photoconductivity generally. Moreover, various properties of the azo pigments can readily be obtained by selecting the combination of the azo component and the coupler component. Accordingly, many azo pigments have been reported as charge-generating substances, for example, in Japanese Patent Application Laid-Open Nos. 57-116345 and 58-95742, and so forth.

Recently, to meet the demand for higher picture quality and higher durability, electrophotographic photosensitive members are being investigated for better characteristics thereof.

SUMMARY OF THE INVENTION

An object of the present invention is to provide an electrophotographic photosensitive member comprising a photosensitive layer containing a novel photoconductive material.

Another object of the present invention is to provide an electrophotographic photosensitive member having high sensitivity, and stable potential characteristics even when it is repeatedly used.

A further object of the present invention is to provide an electrophotographic apparatus and a facsimile machine employing the above-mentioned electrophotographic photosensitive member.

According to an aspect of the present invention, there is provided an electrophotographic photosensitive member comprising an electroconductive support and a photosensitive layer formed thereon, the photosensitive layer containing at least one of the azo pigments represented by the formula [1], [2], or [3] below:

[1]

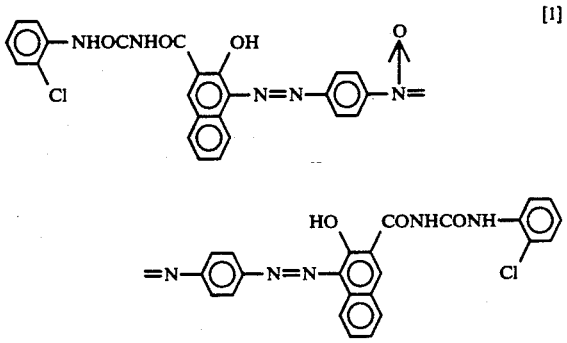

[2]

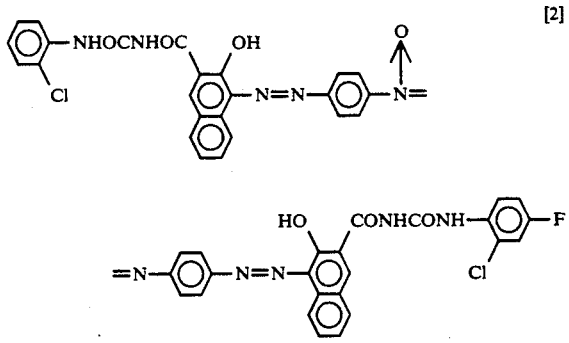

[3]

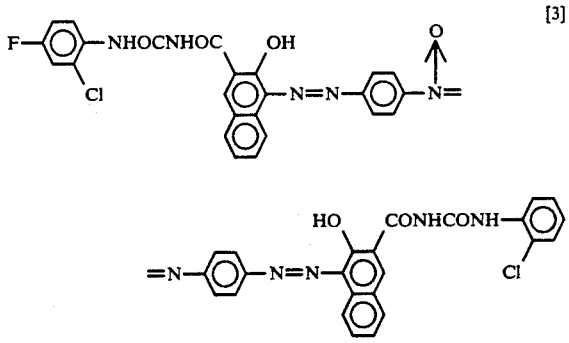

According to another aspect of the present invention, there is provided an electrophotographic apparatus employing the electrophotographic photosensitive member specified above.

According to still another aspect of the present invention, there is provided a facsimile machine employing the electrophotographic photosensitive member specified above.

DESCRIPTION OF THE PREFERRED EMBODIMENT

Figure 1:
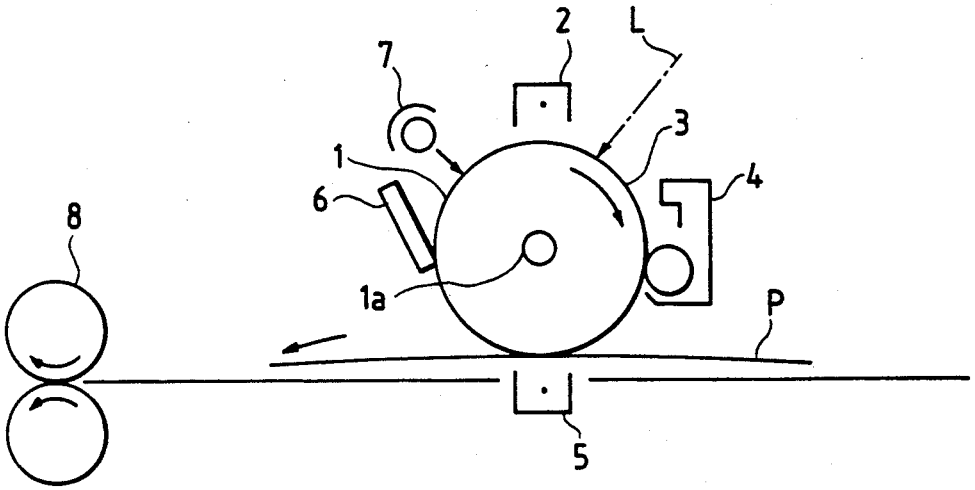
FIG. 1 illustrates outline of the constitution of an electrophotographic apparatus employing the electrophotographic photosensitive member of the present invention.

The photosensitive member of the present invention comprises an electrophotographic photosensitive layer containing at least one of the azo pigments represented by the formula [1], [2], or [3] below:

[1]

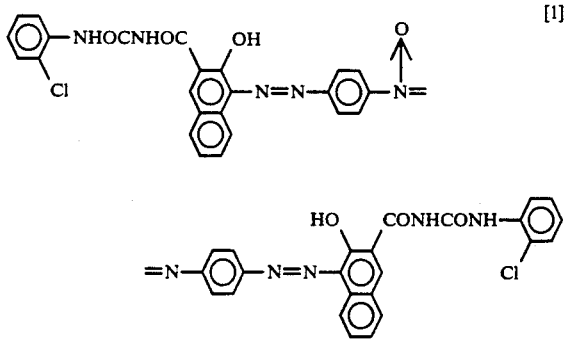

[2]

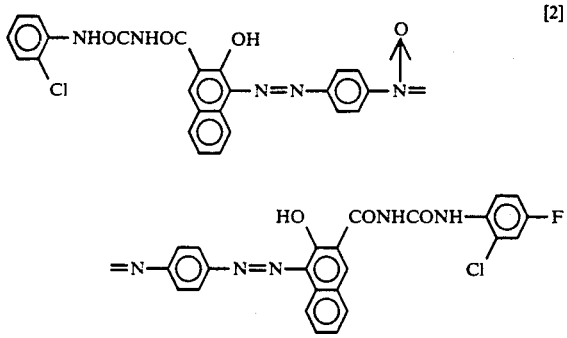

[3]

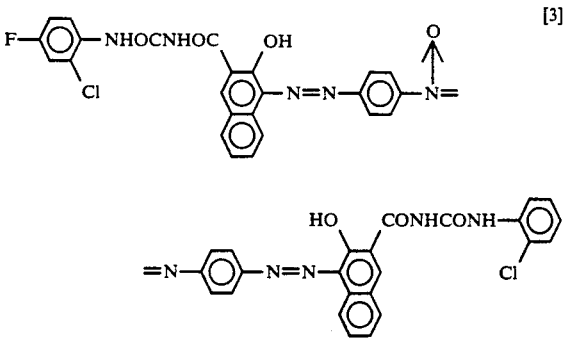

The azo pigment represented by the general formula [1], [2], or [3] may be synthesized by tetrazotizing a diamine corresponding to the pigment into the tetrazonium salt in a conventional manner and coupling the tetrazonium salt with a coupler in an aqueous solution in the presence of an alkali, or otherwise by isolating the above tetrazonium salt of the diamine as a borofluoride salt or zinc chloride-double salt, and coupling the isolated salt with a coupler in a suitable solvent such as N,N-dimethylformamide and dimethylsulfoxide in the presence of a base such as sodium acetate, triethylamine, N-menthymorpholine.

The azo pigment represented by the formula [2], or [3] which has different coupler moieties may be synthesized by firstly coupling one mole of the above tetrazonium salt with one mole of a first coupler and subsequently coupling it with a second coupler, or otherwise may be synthesized by protecting one amino group of the diamine by acetylation or the like, and diazotizing and coupling it with a first coupler and then removing the protecting group by hydrolysis with hydrochloric acid or the like, and diazotizing and coupling the deprotected amino group with a second coupler.

SYNTHESIS EXAMPLE 150 ml of water, 20 ml (0.23 mol) of concentrated hydrochloric acid, and 7.3 g (0.032 mol) of the 4,4'-diamino-azoxybenzene were placed in 300-ml beaker. The mixture was cooled to 0° C. Thereto, a solution of 4.6 g (0.067 mol) of sodium nitrite in 10 ml of water was added dropwise in 10 minutes at the liquid temperature of 5° C. or below. After stirring the liquid for 15 minutes, the liquid was filtered with carbon. To the filtrate, a solution of 10.5 g (0.096 mol) of sodium borofluoride in 90 ml of water was added dropwise with stirring. The deposited borofluoride salt was collected by filtration, washed with cold water and then with acetonitrile, and dried at room temperature under reduced pressure. The yield was 9.7 g (yield rate: 74%)

Separately, 500 ml of N,N-dimethylformamide was placed in a 1-liter beaker. Therein 14.3 g (0.042 mol) of 2-hydroxy-3-[2-(chlorophenyl)allophanoyl]-naphthalene was dissolved, and the solution was cooled to a temperature of 5° C. Thereto, 8.2 g (0.020 mol) of the borofluoride salt obtained above was dissolved, and 5.1 g (0.050 mol) of N-methylmorpholine was added dropwise in 5 minutes. The liquid was stirred for 2 hours. The deposited pigment was collected by filtration, washed four times with N,N-dimethylformamide and three times with water, and freeze-dried to obtain the azo pigment represented by the formula [1]. The yield was 17.0 g (yield rate: 91%). The result of elemental analysis of the obtained diazo pigment was as below.

| | Calculated (%) | Found (%) |
|---|---|---|
| C | 61.87 | 61.98 |
| H | 3.46 | 3.29 |
| N | 15.03 | 15.42 |

The photosensitive layer of the electrophotographic photosensitive member of the present invention may be of a lamination type which is constituted of two separate functional layers of a charge-generating layer containing at least one of the compounds of the formula [1], [2], or [3] and a charge-transporting layer containing a charge-transporting substance, or the photosensitive layer may be of a single layer type which contains at least one of the compounds of the formula [1], [2], or [3] and a charge-transporting substance in one and the same layer. The lamination type of photosensitive layer is preferred to the single layer type one.

The charge-generating layer may be formed by applying, onto an electroconductive support, a coating liquid which has been prepared by dispersing the azo pigment of the present invention and a binder in a suitable solvent by a known method. The film thickness is preferably not more than 5 μm, more preferably in the range of from 0.05 to 1 μm.

The binder resin used therefor may be selected from a variety of insulating resins and organic photoconductive polymers. Preferred resins are polyvinylbutyrals, polyvinylbenzals, polyarylates, polycarbonates, polyesters, phenoxy resins, cellulose resins, acrylic resins, polyurethanes, and the like. The content of the binder resin in the charge-generating layer is preferably not more than 80% by weight, more preferably not more than 55% by weight.

The solvent is preferably selected from those which will dissolve the above-mentioned resin but will not dissolve the charge-transporting layer nor the subbing layer described later. Specific examples of the solvents include ethers such as tetrahydrofuran and 1,4-dioxane; ketones such as cyclohexanone and methyl ethyl ketone; amides such as N,N-dimethylformamide; esters such as methyl acetate and ethyl acetate; aromatic solvents such as toluene, xylene and chlorobenzene; alcohols such as methanol, ethanol and 2-propanol; aliphatic halogenated hydrocarbons such as chloroform, methylene chloride, dichloroethylene, carbon tetrachloride and trichloroethylene; and the like. The solvents are preferable which dissolve neither the charge-transporting layer nor the subbing layer described later.

The charge-transporting layer may be formed inside or outside the charge-generating layer in lamination, and functions to receive charge carriers from the charge-generating layer and to transport the carriers under an electric field applied.

The charge-transporting layer may be formed by applying a solution of a charge-transporting substance and, if necessary, an additional suitable binder resin in a solvent. The layer thickness is preferably in the range of from 5 to 40 μm, more preferably from 15 to 30 μm.

The charge-transporting substances includes electron-transporting substances and positive-hole-transporting substances. The examples of the electron-transporting substances are electron-attracting substances such as 2,4,7-trinitrofluorenone, 2,4,5,7-tetranitrofluoroenone, chloranil, and tetracyanoquinodimethane; and polymers of such electron-attracting substances.

The examples of the positive-hole-transporting substances are polycyclic aromatic compounds such as pyrene and anthracene; heterocyclic compounds including carbazoles, indoles, imidazoles, oxazoles, thiazoles, oxadiazoles, pyrazoles, pyrazolines, thiadiazoles, and triazoles; hydrazone compounds such as p-diethylaminobenzaldehyde-N,N-diphenylhydrozone, and N,N-diphenylhydrazino-3-methylidene-9-ethylcarbazole; styryl compounds such as α-phenyl-4'-N,N-diphenylaminostilbene, and 5-[4-(di-p-tolylamino)benzylidene]-5H-dibenzo[a,d]cycloheptene; benzidine compounds; triarylmethanes; arylamines such as triphenylamine, tri-p-tolylamine; and N,N-di-p-tolyl-2-amino-9,9-dimethylfluorenone; and polymers having a radical derived from the above compound in the main chain or the side chain thereof such as poly-N-vinylcarbazole, polyvinylanthracene, etc.

In addition to these organic charge-transporting substances, inorganic materials such as selenium, selenium-tellurium, amorphous silicon, and cadmium sulfide may also be used. Two or more of the above charge-transporting substances may be used in combination.

If the charge-transporting substance does not have a film-forming property, a suitable binder may be used. The specific examples of the binder include insulating resins such as acrylic resins, polyarylates, polyesters, polycarbonates, polystyrenes, acrylonitrile-styrene copolymers, polyacrylamides, polyamides, chlorinated rubbers, and the like; and organic photoconductive polymers such as poly-N-vinylcarbazole, polyvinylanthracene, and the like.

The electroconductive support may be made of such a material as aluminum, aluminum alloy, copper, zinc, stainless steel, titanium, nickel, indium, gold, and platinum. Further, the electroconductive support may be a plastic on which a film of the metal or metal alloy as mentioned above is formed by vacuum vapor deposition (the plastic including polyethylene, polypropylene, polyvinyl chloride, polyethylene terephthalate, acrylic resins, and the like); or may be a plastic or metal substrate which is coated with a mixture of electroconductive particles (such as carbon black particles, and silver particles) and a suitable binder; or otherwise may be a plastic or paper sheet impregnated with electroconductive particles.

The electroconductive support may be in a shape of a sheet, a drum, or the like, and is preferably formed in a suitable shape for the electrophotographic apparatus to be employed.

A subbing layer having functions of a barrier and an adhesive may be provided between the electroconductive support and the photosensitive layer. The subbing layer may be made of casein, polyvinyl alcohol, nitrocellulose, polyamide (such as nylon 6, nylon 66, nylon 610, a copolymer nylon, and alkoxymethylated nylon), polyurethane, aluminum oxide, and the like. The thickness of the subbing layer is preferably not more than 5 μm, more preferably in the range of from 0.1 to 3 μm.

Other specific examples of the present invention are electrophotographic photosensitive members having a single layer type of photosensitive layer which contains the azo pigment of the present invention and a charge-transporting substance in one and the same layer. In such examples, a charge-transfer complex such as a combination of poly-N-vinycarbazole and trinitrofluorenone may also be useful as the charge-transporting substance. Such a type of electrophotographic photosensitive member may be formed by applying on a support a liquid dispersion prepared by dispersing the aforementioned azo pigment and a charge-transfer complex in a suitable resin solution.

In the present invention, as a protecting layer, a simple resin layer or a resin layer containing electroconductive particles may further be provided on the photosensitive layer.

The aforementioned layers may be formed according to a suitable coating method such as dip coating, spray coating, spinner coating, bead coating, blade coating, and beam coating.

The azo pigment of Formula [1], [2], or [3] may either be amorphous or be crystalline. These azo pigments may be used individually or in combination of two or more thereof, or may be used in combination with other known charge-generating substance.

The electrophotographic photosensitive member of the present invention is not only useful for electrophotographic copying machines but also useful for a variety of application fields of electrophotography including facsimile machines, laser beam printers, CRT printers, LED printers, liquid crystal printers, laser engraving systems, and so forth.

FIG. 1 shows a schematic diagram of a transfer type electrophotographic apparatus employing the electrophotographic photosensitive member of the present invention.

In FIG. 1, a drum type photosensitive member 1 serves as an image carrier, being driven to rotate around the axis 1*a* in the arrow direction at a predetermined peripheral speed. The photosensitive member 1 is uniformly charged positively or negatively at the peripheral face during the rotation by an electrostatic charging means 2, and then exposed to image-exposure light L (e.g. slit exposure, laser beam-scanning exposure, etc.) at the exposure portion 3 with an image-exposure means (not shown in the figure), whereby electrostatic latent images are sequentially formed on the peripheral surface in accordance with the exposed image.

The electrostatic latent image is developed with a toner by a developing means 4. The toner-developed images are sequentially transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the figure.

The transfer-receiving material P having received the transferred image is separated from the photosensitive member surface, and introduced to an image fixing means 8 for fixiation of the image and sent out from the copying machine as a duplicate copy.

The surface of the photosensitive member 1, after the image transfer, is cleaned with a cleaning means 6 to remove any remaining untransferred toner, and is treated for charge-elimination with a pre-exposure means 7 for repeated use for image formation.

The generally employed charging means 2 for uniformly charging the photosensitive member 1 is a corona charging apparatus. As the transfer means 5, a corona charging means is also usually used widely. In the electrophotographic apparatus, two or more of the constitutional elements of the above described photosensitive member, the developing means, the cleaning means, etc. may be integrated into one apparatus unit, which may be made demountable from the main body of the apparatus. For example, at least one of an electrostatic charging means, a developing means, and a cleaning means is combined with the photosensitive member into one unit demountable from the main body of the apparatus by aid of a guiding means such as a rail in the main body of the apparatus. An electrostatic charging means and/or a developing means may be combined with the aforementioned apparatus unit.

In the case where the electrophotographic apparatus is used as a copying machine or a printer, the optical image exposure light L is projected onto the photosensitive member as reflected light or transmitted light from an original copy, or otherwise the signalized information is read out by a sensor from an original copy and then scanning with a laser beam, driving an LED array, or driving a liquid crystal shutter array according to the signal and the exposure light is projected onto a photosensitive member.

Figure 2:
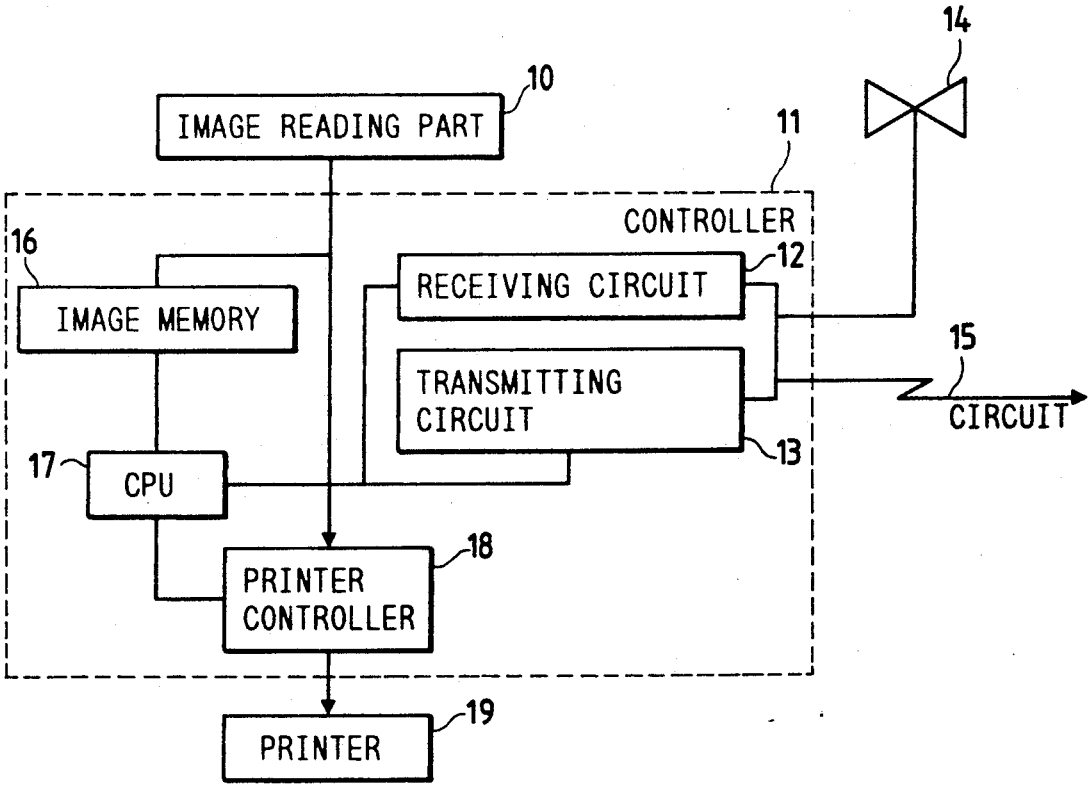
FIG. 2 illustrates a block diagram of a facsimile employing the electrophotographic photosensitive member of the present invention.

In the case where the electrophotographic apparatus is used as a printer of a facsimile machine, the optical image exposure light L is for printing the received data. FIG. 2 is a block diagram of an example of this case.

A controller 11 controls an image reading part 10 and a printer 19. The entire of the controller 11 is controlled by a CPU 17. Readout data from the image reading part is transmitted through a transmitting circuit 13 to the other communication station. Data received from the other communication station is transmitted through a receiving circuit 12 to a printer 19. The image data is stored in image memory. A printer controller 18 controls a printer 19. The numeral 14 denotes a telephone set.

The image received through a circuit 15, namely image information from a remote terminal connected through the circuit, is demodulated by the receiving circuit 12, treated for decoding of the image information in CPU 17, and successively stored in the image memory 16. When at least one page of image information has been stored in the image memory 16, the images are recorded in such a manner that the CPU 17 reads out the one page of image information from the image memory 16, and sends out the decoded one page of information to the printer controller 18, which controls the printer 19 on receiving the one page of information from CPU 17 to record the image information.

During recording by the printer 19, the CPU 17 receives the subsequent page of the information.

Images are received and recorded in the manner as described above.

The present invention is described in more detail with reference to examples.

EXAMPLE 1

Onto an aluminum substrate, a solution of 5 g of methoxymethylated nylon (weight-average molecular weight: 32,000) and 10 g of alcohol-soluble copolymer nylon (weight-average molecular weight: 29,000) in 95 g of methanol was applied with a Meyer bar to form a subbing layer of 1 μm in dry thickness.

Separately, 5 g of the azo pigment of Formula [1] was added to a solution of 2 g of a butyral resin (butyralation degree: 80 mol %) in 95 g of cyclohexanone, and was dispersed for 10 hours by means of a sand mill. The resulting liquid dispersion was applied on the subbing layer having been formed as above with a Meyer bar and dried to give a charge-generating layer of 0.3 μm in dry thickness.

Subsequently, 5 g of the hydrazone compound represented by the formula below:

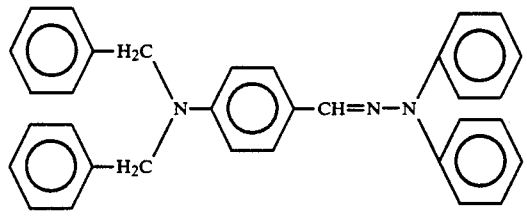

and 5 g of polymethyl methacrylate resin (weight-average molecular weight:100,000) were dissolved in 40 g of chlorobenzene. The solution was applied onto the above-mentioned charge-generating layer with a Meyer bar and dried to form a charge-transporting layer of 23 μm in dry thickness, thereby an electrophotographic photosensitive member being prepared.

This electrophotographic photosensitive member was tested for charging characteristics by means of an electrostatic copying-paper tester (Model SP-428, made by Kawaguchi Denki K.K.) by subjecting the member to corona discharge at −5 KV to charge it negatively, leaving it in the dark for 1 second, and exposing it to light of illuminance of 10 lux by use of a halogen lamp.

The charging characteristics measured were the surface potential ($V_0$) immediately after the charging, and the quantity of light exposure ($E_{\frac{1}{2}}$) required for decay of the surface potential by half after 1 second of standing in the dark, namely sensitivity.

The results are shown in Table 1.

EXAMPLES 2-3

Electrophotographic photosensitive members were prepared and evaluated in the same manner as in Example 1 except that the azo pigment of Formula [2] or Formula [3] is respectively used in place of the azo pigment used in Example 1.

The results are shown in Table 1.

TABLE 1

| Example No. | Azo pigment | $V_0$ (−V) | $E_{\frac{1}{2}}$ (lux · sec) |
|---|---|---|---|
| 1 | Formula [1] | 700 | 1.0 |
| 2 | Formula [2] | 700 | 1.1 |
| 3 | Formula [3] | 700 | 1.3 |

COMPARATIVE EXAMPLES 1 AND 2

Electrophotographic photosensitive members were prepared and evaluated in the same manner as in Example 1 except that the azo pigment represented by the formulas below was used respectively. The results are shown in Table 2.

TABLE 2

| Comparative Example | Comparative Pigment | $V_0$ (−V) | $E_{\frac{1}{2}}$ (lux · sec) |
|---|---|---|---|
| 1 | (1) | 670 | 5.0 |
| 2 | (2) | 660 | 5.5 |

Comparative Pigment (1):

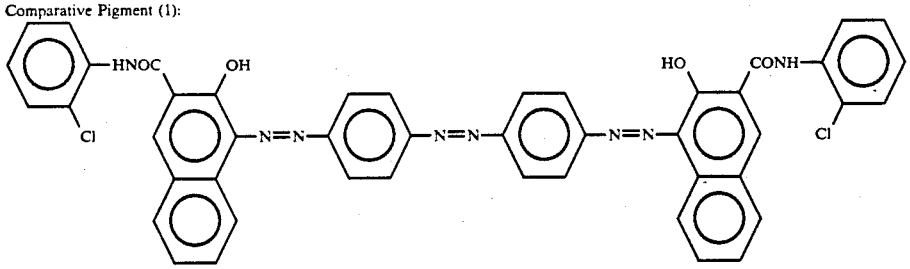

Comparative Pigment (2):

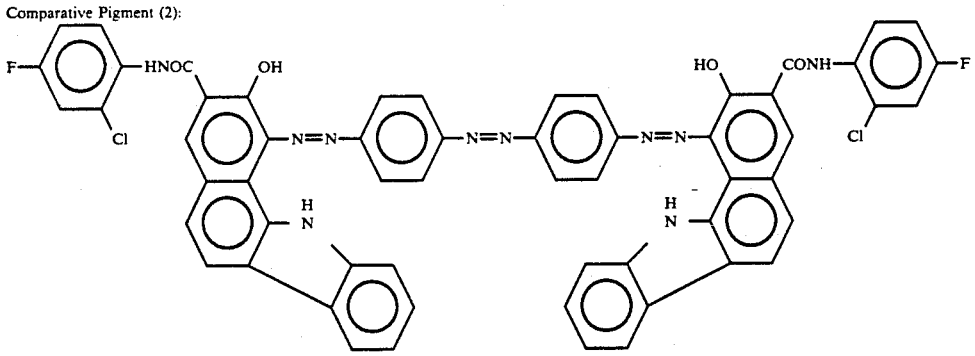

EXAMPLES 4, 5, and 6

The electrophotographic photosensitive member prepared in Example 1 was sticked onto a cylinder of an electrophotographic copying machine equipped with a −6.5 KV corona charger, a light-exposing system, a developer, a transfer-charger, a destaticizing light-exposing system, and a cleaner.

With this copying machine, the dark portion potential ($V_D$) and light portion potential ($V_L$) at the initial stage were set respectively at approximately −700 V and −200 V, and the changes of the dark-portion potential ($\Delta V_D$) and the light-portion potential ($\Delta V_L$) caused by 5000 times of copying were measured to evaluate the durability characteristics.

The electrophotographic photosensitive members prepared in Examples 2 and 3 were evaluated in the same manner.

The results are shown in Table 3, where the negative value of the change denotes the decrease of the absolute value of the potential and the positive value of the change denotes the increase of the absolute value of the potential.

TABLE 3

| Example No. | Azo pigment | $\Delta V_D$ (V) | $\Delta V_L$ (V) |
|---|---|---|---|
| 4 | Formula [1] | 0 | 0 |
| 5 | Formula [2] | −5 | 0 |
| 6 | Formula [3] | −5 | 3 |

COMPARATIVE EXAMPLES 3 AND 4

The electrophotographic photosensitive members prepared in Comparative Examples 1 and 2 were tested for potential change in repeated use in the same manner as in Example 4. The results are shown in Table 4.

TABLE 4

| Comparative Example | Comparative Pigment | $\Delta V_D$ (V) | $\Delta V_L$ (V) |
|---|---|---|---|
| 3 | (1) | −35 | +45 |
| 4 | (2) | −45 | +30 |

EXAMPLE 7

On an aluminum surface of an aluminum-vapor-deposited polyethylene terephthalate film, a subbing layer of polyvinyl alcohol (weight-average molecular weight:80,000) of 0.5 μm thick was formed. Thereon, the same liquid dispersion of the azo pigment as the one employed in Example 1 was applied with a Meyer bar, and the applied layer was dried to form a charge-generating layer of 0.3 μm thick.

Subsequently, a solution of 5 g of the styryl compound of the formula below:

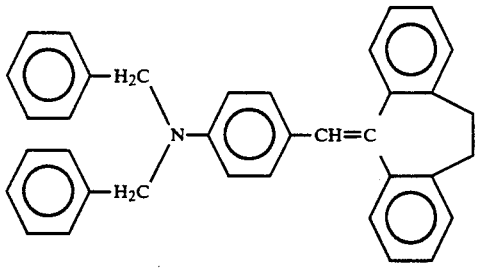

and 5 g of a polycarbonate resin (weight-average molecular weight:55,000) in 40 g of tetrahydrofuran was applied on the charge-generating layer, and was dried to form a charge-transporting layer of 21 μm thick.

The electrophotographic photosensitive member prepared thus was tested for the charging characteritics and durability characteristics in the same manners as in Example 1 and Example 4. The results are as shown below.

$V_0$: −700 V
$E_{\frac{1}{2}}$: 0.9 lux.sec
$\Delta V_D$: 0 V
$\Delta V_L$: 0 V.

EXAMPLE 8

An electrophotographic photosensitive member was prepared in the same manner as in example 7 except that the charge-generating layer and the charge-transporting layer were formed in the reversed order. The resulting electrophotographic photosensitive member was evaluated for charging characteristics in the same manner as in Example 1 except for application of a positive charging potential. The results are as below.

$V_0$: +690 V
$E_{\frac{1}{2}}$: 1.7 lux.sec.

EXAMPLE 9

On the charge-generating layer prepared in Example 1, a solution of 5 g of 2,4,7-trinitro-9-fluorenone and 5 g of poly-4,4'-dioxydiphenyl-2,2-propane carbonate (weight-average molecular weight: 300,000) in 50 g of tetrahydrofuran was applied with a Meyer bar and dried to form a charge-transporting layer of 18 μm thick.

The resulting electrophotographic photosensitive member was evaluated for the charging characteristics in the same manner as in Example 1 except for application of a positive charging potential. The results are as shown below.

$V_0$: +680 V
$E_{\frac{1}{2}}$: 3.5 lux.sec.

EXAMPLE 10

0.5 g of the azo pigment of Formula [1] was dispersed in 9.5 g of cyclohexanone by means of a paint shaker for 5 hours. Thereto, a solution of 5 g of the charge-transporting substance and 5 g of the polycarbonate resin (weight-average molecular weight: 60,000) in 40 g of tetrahydrofuran as used in Example 1 was added, and the mixture was shaken further for one hour. The coating solution prepared thus was applied onto an aluminum substrate with a Meyer bar and was dried to form a photosensitive layer of 19 μm thick.

The electrophotographic photosensitive member prepared thus was evaluated for its charging characteristics in the same manner as in Example 1 except for application of a positive charging potential.

The results are as below.

$V_0$: +680 V
$E_{\frac{1}{2}}$: 4.6 lux.sec.

As described above, the electrophotographic photosensitive member of the present invention is improved in the generation efficiency and/or the injection efficiency of the charge carrier in the interior of the photosensitive layer, and is superior in potential stability in repeated use.

What is claimed is:

1. An electrophotographic photosensitive member comprising an electroconductive support and a photosensitive layer formed thereon, the photosensitive layer containing at least one of the azo pigments represented by the formula [1], [2], or [3] below:

[1]

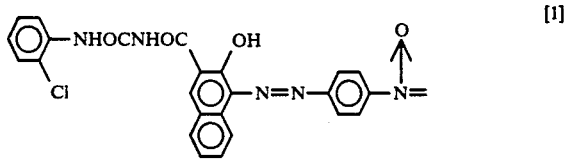

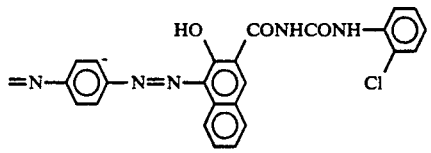

[2]

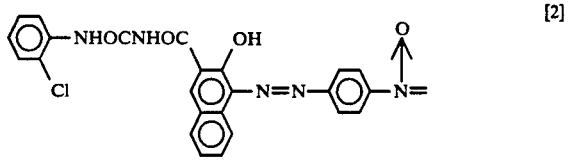

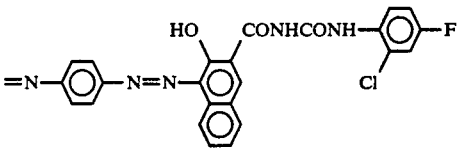

[3]

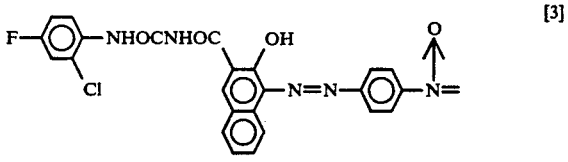

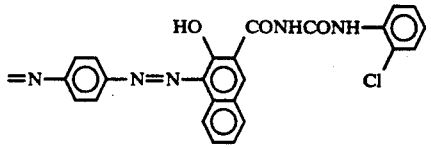

2. An electrophotographic photosensitive member according to claim 1, wherein the photosensitive layer contains the azo pigment represented by the formula [1] below:

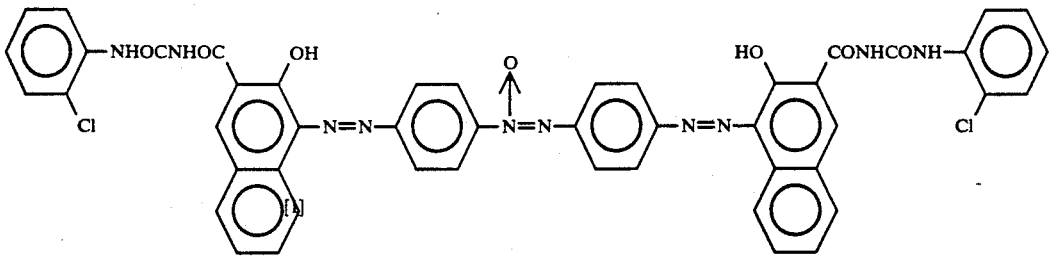

[1]

3. An electrophotographic photosensitive member according to claim 1, wherein the photosensitive layer contains the azo pigment represented by the formula [2] below:

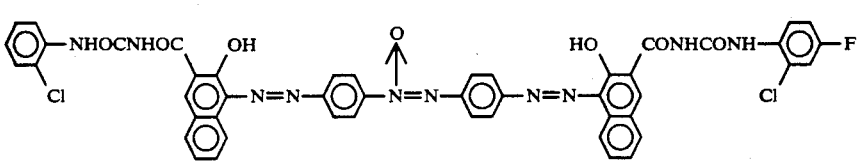

[2]

4. An electrophotographic photosensitive member according to claim 1, wherein the photosensitive layer contains the azo pigment represented by the formula [3] below:

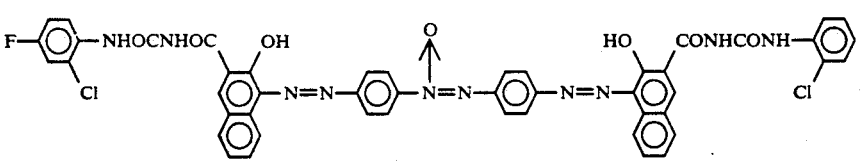

[3]

5. An electrophotographic photosensitive member according to claim 1, wherein the photosensitive layer comprises a charge-generating layer and a charge-transporting layer.

6. An electrophotographic photosensitive member according to claim 5, wherein the electrophotographic photosensitive member has an electroconductive support, a charge-generating layer formed thereon, and a charge-transporting layer formed further thereon.

7. An electrophotographic photosensitive member according to claim 5, wherein the electrophotographic photosensitive member has an electroconductive support, a charge-transporting layer formed thereon, and a charge-generating layer formed further thereon.

8. An electrophotographic photosensitive member according to claim 1, wherein the photosensitive layer is constituted of a single layer.

9. An electrophotographic photosensitive member according to claim 1, wherein the electrophotographic photosensitive member has a subbing layer between the electrophotographic support and the photosensitive layer.

10. An electrophotographic photosensitive member according to claim 1, wherein the electrophotographic photosensitive member has a protecting layer formed on the photosensitive layer.

11. An electrophotographic apparatus, comprising an electrophotographic photosensitive member, a means for forming an electrostatic latent image, a means for developing the electrostatic latent image formed, and a means for transferring a developed image onto a transfer-receiving material; said electrophotographic photosensitive member comprising an electroconductive support and a photosensitive layer formed thereon, wherein the photosensitive layer contains at least one of the azo pigments represented by the general formula [1], [2], or [3]:

[1]

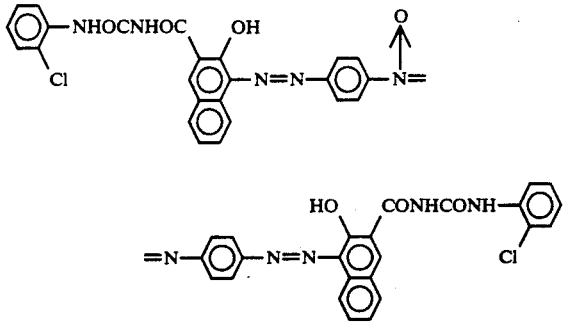

[2]

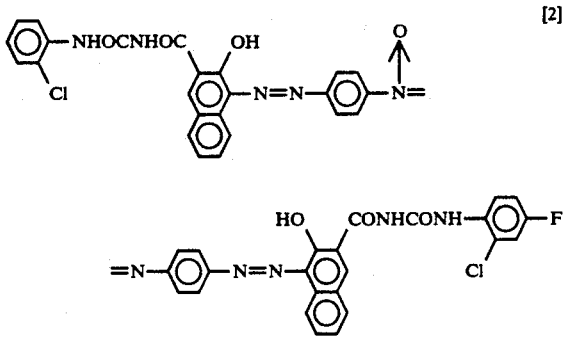

-continued

[3]

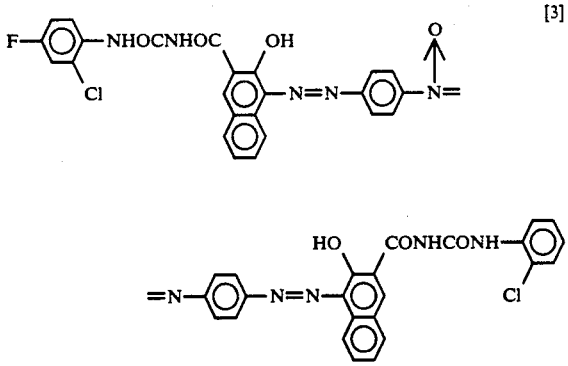

12. A device unit comprising an electrophotographic photosensitive member, a charging means, and a cleaning means; said electrophotographic photosensitive member comprising an electroconductive support and a photosensitive layer formed thereon, wherein the photosensitive layer contains at least one of the azo pigments represented by the formula [1], [2], or [3] below:

[1]

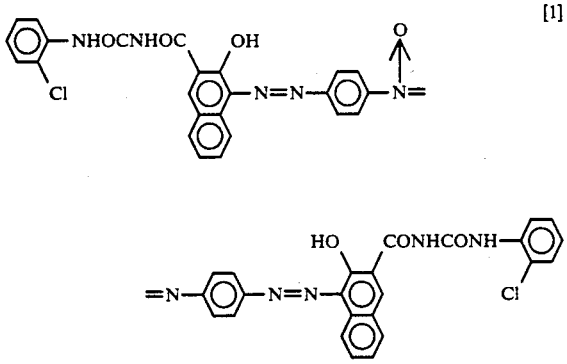

[2]

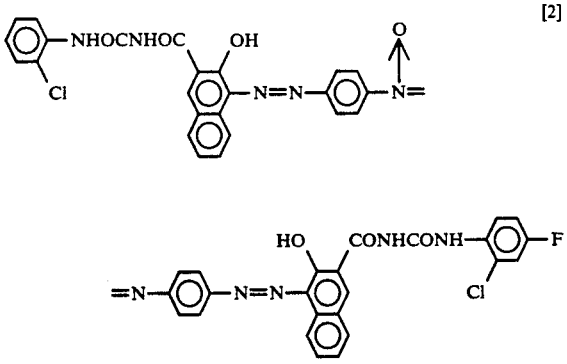

[3]

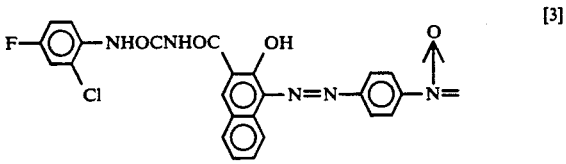

-continued

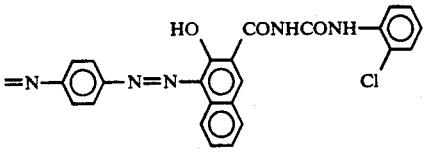

and the unit holds the electrophotographic photosensitive member, the charging means, and the cleaning means integrally, and is demountable from the main body of an electrophotographic apparatus.

13. A device unit according to claim 12, wherein the unit comprises a developing means.

14. A facsimile machine, comprising an electrophotography apparatus and a signal-receiving means for receiving image information from a remote terminal:

said electrophotography apparatus comprising an electrophotographic photosensitive member, said electrophotographic photosensitive member comprising an electroconductive support and a photosensitive layer formed thereon, wherein the photosensitive layer contains at least one of the azo pigments represented by the formula [1], [2] or [3] below:

[1]

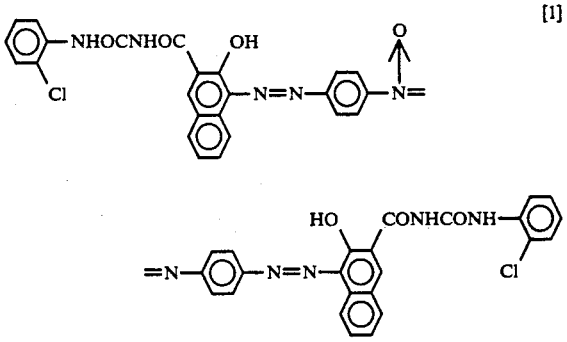

[2]

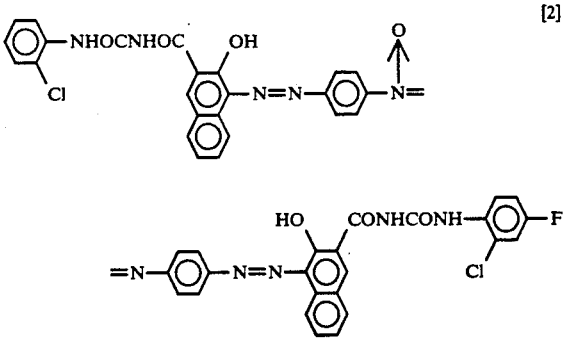

[3]

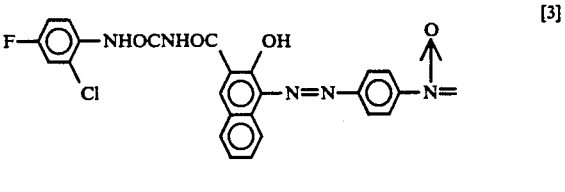

* * * * *